United States Patent [19]

Agner

[11] Patent Number: 4,704,981

[45] Date of Patent: Nov. 10, 1987

[54] COMBINATION CLEAT AND OARWELL

[76] Inventor: Hugh R. Agner, 30834 Jennie La., Burlington, Wis. 53105

[21] Appl. No.: 886,623

[22] Filed: Jul. 18, 1986

[51] Int. Cl.[4] ..... B63B 21/04

[52] U.S. Cl. ..... 114/218; 440/106; 440/109

[58] Field of Search ..... 440/104–109; 114/218, 270

[56] References Cited

U.S. PATENT DOCUMENTS

| | | | |
|---|---|---|---|
| 1,664,153 | 3/1928 | Borkert | 440/109 |
| 2,252,252 | 8/1941 | Cross | 440/109 |
| 2,602,618 | 7/1952 | Cohen | 248/49 |
| 3,115,113 | 12/1963 | Ellsworth | 114/218 |
| 3,126,858 | 3/1964 | Rosinski | 114/218 |
| 3,232,263 | 2/1966 | O'Brien | 114/218 |
| 3,398,714 | 8/1968 | Wallin et al. | 114/218 |
| 3,905,322 | 9/1975 | Peterman et al. | 114/218 |
| 4,354,445 | 10/1982 | Kafka et al. | 114/218 |
| 4,358,281 | 11/1982 | Woodward | 440/109 |

FOREIGN PATENT DOCUMENTS

| | | | |
|---|---|---|---|
| 587098 | 4/1947 | United Kingdom | 114/218 |
| 1212125 | 11/1970 | United Kingdom | 440/106 |

*Primary Examiner*—Joseph F. Peters, Jr.
*Assistant Examiner*—Stephen P. Avila
*Attorney, Agent, or Firm*—Michael, Best & Friedrich

[57] ABSTRACT

A combination cleat and oarwell apparatus comprising a body portion having mutually perpendicular x, y, and z axes and including a pair or projections extending in opposite directions along the x axis to form a cleat, a first extending portion having therein a first bore extending along the y axis, a second extending portion having therein a second bore extending along the z axis, and a bottom surface parallel to the plane defined by the x and z axes and adapted to be attached alternatively to a generally horizontal surface of a boat hull and to a generally vertical surface of a boat hull, a first bushing in the first bore, and a second bushing in the second bore.

8 Claims, 4 Drawing Figures

COMBINATION CLEAT AND OARWELL

BACKGROUND OF THE INVENTION

The invention relates to equipment for boats, and more particularly to cleat and oarwell apparatus for boats.

An oarwell provides a bore having a vertical axis into which the pivot pin of an oarlock is inserted. A cleat provides a structure around which line or rope can be wound and secured.

Known oarwell apparatus include a vertically extending bore in the gunwale of a boat, and an apparatus attached to the interior of the side of a boat and having a vertically extending bore therein.

There are many known cleat apparatus, some of which are disclosed in the patents cited below.

No known apparatus provides a combined cleat and oarwell, and no known apparatus provides an oarwell apparatus which can be attached either to the gunwale or to the side of a boat.

Attention is directed to the following U.S. patents which disclose cleat appatatus and other boat equipment. Cohen U.S. Pat. No. 2,602,618, issued July 8, 1952, Rosinski U.S. Pat. No. 3,126,858, issued Mar. 31, 1964, O'Brien U.S. Pat. No. 3,232,263, issued Feb. 1, 1966, Peterman U.S. Pat. No. 3,905,322, issued Sept. 16, 1975, Kafka U.S. Pat. No. 3,354,445, issued Oct. 19, 1982, Woodward U.S. Pat. No. 4,358,281, issued Nov. 9, 1982, and Ellsworth U.S. Pat. No. 3,115,113, issued Dec. 24, 1963.

SUMMARY OF THE INVENTION

The invention provides a combination cleat and oarwell apparatus which can be attached to either the gunwale of a boat (the horizontal upper edge of the side of a boat), or to the vertical inner surface of the side of a boat. This latter positioning is often desirable on canoes, as the gunwale of a canoe may not provide adequate support for an oarwell apparatus.

The apparatus of the preferred embodiment comprises a body portion having a bottom surface adapted to be attached alternatively to a horizontal surface and to a vertical surface as described above. The body portion also includes a pair of projections extending in opposite directions to form a cleat. In the preferred embodiment, the projections extend along a line parallel to the bottom surface. The body portion further includes a pair of perpendicular extending portions having bores therein. One of the bores extends along a line perpendicular to the bottom surface, and the other of the bores extends along a line parallel to the bottom surface. Preferably, the second bore also extends along a line perpendicular to the line of the cleat projections, so that the three axes of the cleat projections and the two bores are mutually perpendicular.

When the bottom surface is attached to a horizontal surface, one of the bores forms a vertically extending oarwell aperture, and the other bore forms a horizontally extending side aperture. When the bottom surface is attached to a vertical surface, the bores are reversed, so that the other bore above forms a vertically extending oarwell aperture, and the one bore above forms a horizontally extending side aperture. The side aperture can be used as a means for hanging or mounting objects on the side of the boat.

In the preferred embodiment, the apparatus further comprises bushings in the two apertures to reduce friction between the apparatus and an oarlock pivot pin inserted into either of the apertures.

A principal feature of the invention is the provision of an apparatus which is a combination cleat and oarwell.

Another principal feature of the invention is the provision of an oarwell apparatus whicn can be attached either to a horizontal surface or to a vertical surface.

Other features and advantages of the invention will become apparent to those skilled in the art upon review of the following detailed description, claims, and drawings.

Figure 1:
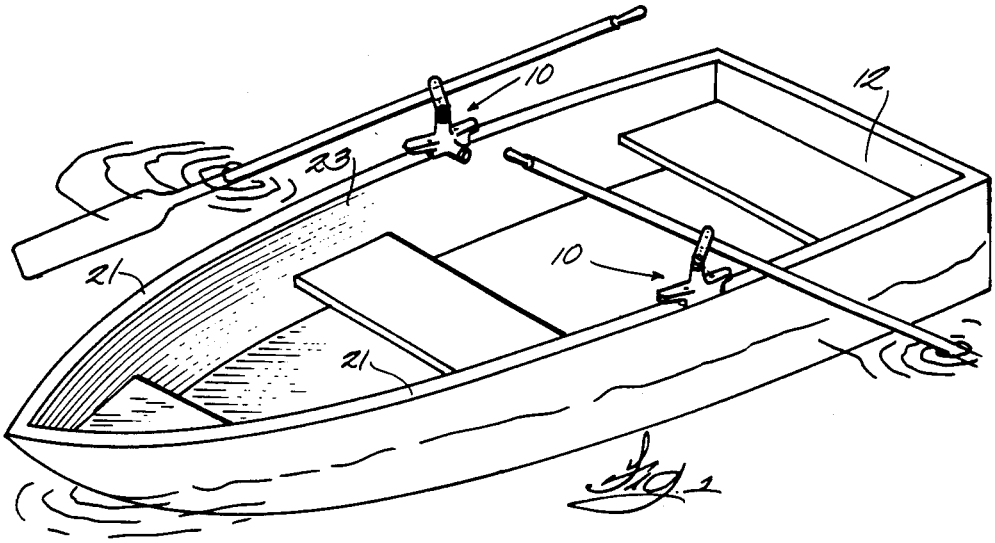
FIG. 1 is a perspective view of a boat including an apparatus embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
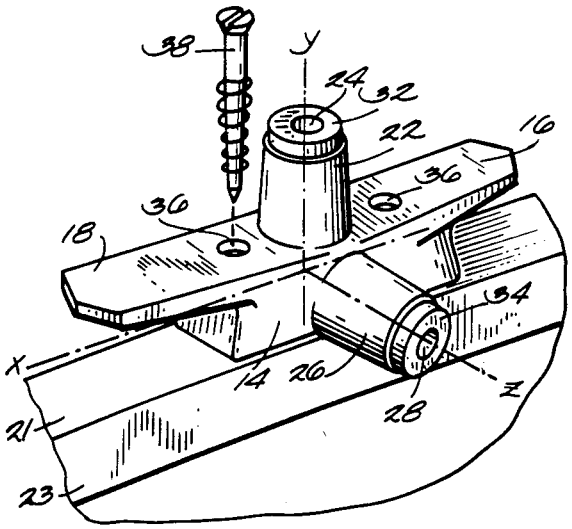
FIG. 2 is a perspective view of an apparatus embodying the invention mounted on the gunwale of a boat.
Figure 3:
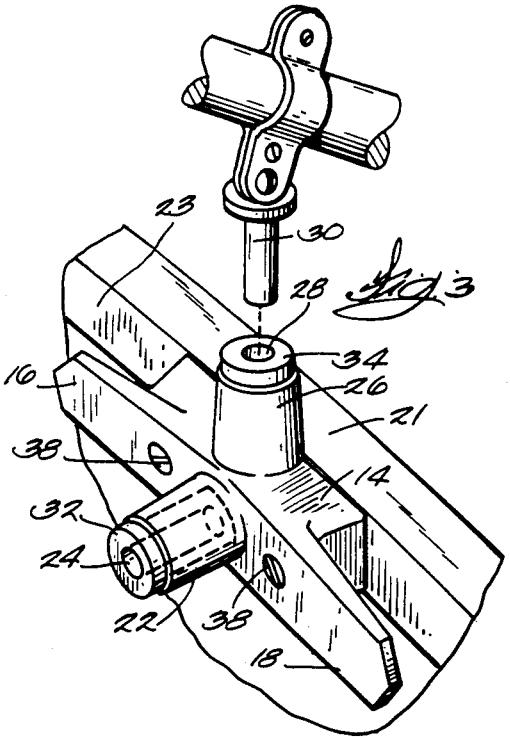
FIG. 3 is a perspective view of the apparatus mounted on the inner surface of the side of a boat.

An apparatus 10 embodying the invention is illustrated in the drawings. The apparatus 10 is shown in FIG. 1 mounted on a rowboat 12. As best shown in FIGS. 2 and 3, the apparatus 10 comprises a body portion 14 including opposite sides, and means defining recesses in the opposite sides of the body portion 14 so as to form a cleat. In the preferred embodiment, the means defining recesses includes a first projection 16 extending laterally from one side of the body portion 14, and a second projection 18 extending laterally from the other side of the body portion 14.

Figure 4:
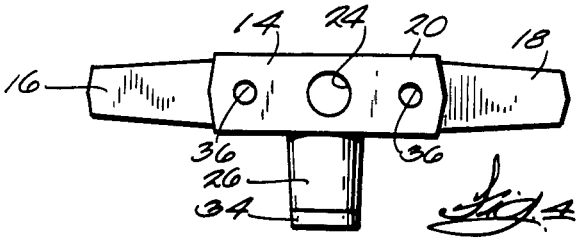
FIG. 4 is a bottom view of the apparatus.

As best shown in FIG. 4, the body portion 14 preferably also includes a bottom surface 20 adapted to be attached alternatively to a generally horizontal surface or gunwale 21 of the boat hull (FIG. 2), and to a generally vertical surface 23 of the boat hull (FIG. 3).

The body portion 14 also includes an oarwell aperture. Preferably, the body portion 14 includes a first extending portion 22 having a first bore 24 therein, the first bore 24 having an axis generally perpendicular to the bottom surface 20, and a second extending portion 26 perpendicular to the first extending portion 22 and having a second bore 28 therein, the second bore 28 having an axis generally parallel to the bottom surface 20. The bores 24 and 28 form oarwell apertures adapted to receive an oarlock pivot pin 30 as shown in FIGS. 1 and 3. Preferably, the apparatus further comprises a bushing 32 in the first bore 24, and a bushing 34 in the second bore 28. The bushings 32 and 34 reduce friction between the apparatus 10 and the oarlock pivot pin 30.

In the preferred embodiment, as shown in FIG. 2, the first and second projections 16 and 18 extend in opposite directions along or parallel to an x axis parallel to the bottom surface 20, the first bore 24 extends along a y axis perpendicular to the x axis and to the bottom surface 20, and the second bore 28 extends along a z axis perpendicular to both the x and y axes and parallel to the bottom surface 20.

The body portion 14 can be attached to the boat hull by any suitable means. Preferably, the body portion 14 includes apertures 36 on either side of the first extending portion 22 and having axes parallel to the y axis. A screw 38 (FIG. 2) is inserted through each of the apertures 36 and is threaded into the boat hull to secure the body portion 14 to the boat hull.

Thus, when the bottom surface 20 is attached to a horizontal surface (FIG. 2), the first bore 24 forms a vertically extending oarwell aperture, and the second bore 28 forms a horizontally extending side aperture. When the bottom surface 20 is attached to a vertical surface (FIG. 3), the second bore 28 forms a vertically extending oarwell aperture, and the first bore 24 forms a horizontally extending side aperture. The side aperture provides means for hanging or mounting an object on the side of a boat. For example, an object such as a device for holding a beverage container or a device for supporting a fishing rod can be mounted in the side aperture.

In either position, the apparatus 10 provides a cleat, an oarwell aperture, and a horizontally extending side aperture.

Other features and advantages of the invention are set forth in the following claims.

I claim:

1. An oarwell apparatus comprising a body portion including opposite sides and a generally flat bottom surface adapted to be attached alternatively to a generally horizontal surface of a boat hull and to a generally vertical surface of the boat hull, said body portion having therein a first bore with an axis generally perpendicular to said bottom surface and a second bore with an axis generally parallel to said bottom surface, whereby when said bottom surface is attached to a generally horizontal surface, said first bore forms a vertically extending oarwell aperture and said second bore forms a horizontally extending side aperture, and whereby, when said bottom surface is attached to a generally vertical surface, said second bore forms a vertically extending oarwell aperture and said first bore forms a horizontally extending side aperture.

2. An apparatus as set forth in claim 1 and further comprising means defining recesses in said opposite sides of said body portion so as to form a cleat.

3. An apparatus as set forth in claim 2 wherein said means defining recesses includes a first projection extending laterally from one of said opposite sides, and a second projection extending laterally from the other of said opposite sides.

4. An apparatus as set forth in claim 1 wherein said body portion further includes a first extending portion having said first bore therein, and a second extending portion perpendicular to said first extending portion and having said second bore therein.

5. An apparatus as set forth in claim 1 and further comprising a first bushing in said first bore, and a second bushing in said second bore.

6. A combination cleat and oarwell apparatus comprising a body portion having mutually perpendicular x, y and z axes and including a pair of projections extending in opposite directions along said x axis to form a cleat, a first bore extending along said y axis, a second bore extending along said z axis, and a bottom surface parallel to the plane defined by said x and z axes, said bottom surface being adapted to be attached alternatively to a generally horizontal surface of a boat hull and to a generally vertical surface of a boat hull, whereby, when said bottom surface is attached to a generally horizontal surface, said first bore forms a vertically extending oarwell aperture and said second bore forms a horizontally extending side aperture, and whereby, when said bottom surface is attached to a generally vertical surface, said second bore forms a vertically extending oarwell aperture and said first bore forms a horizontally extending side aperture.

7. An apparatus as set forth in claim 6 wherein said body portion further includes a first extending portion extending along said y axis and having said first bore therein, and a second extending portion extending along said z axis and having said second bore therein.

8. An apparatus as set forth in claim 6 and further comprising a first bushing in said first bore, and a second bushing in said second bore.

* * * * *